US006739482B2

(12) United States Patent
Jaekel

(10) Patent No.: US 6,739,482 B2
(45) Date of Patent: May 25, 2004

(54) DRYWALL COMPOUND DISPENSING DEVICE

(76) Inventor: Kevin M. Jaekel, c/o 549 Aspen Street, Durham (CA), N0G 1R0

( * ) Notice: Subject to any disclaimer, the term of this patent is extended or adjusted under 35 U.S.C. 154(b) by 39 days.

(21) Appl. No.: 10/127,672

(22) Filed: Apr. 23, 2002

(65) Prior Publication Data

US 2003/0197028 A1 Oct. 23, 2003

(51) Int. Cl.[7] ..... B67D 5/42
(52) U.S. Cl. ..... 222/192; 222/390
(58) Field of Search ..... 222/192, 390

(56) References Cited

U.S. PATENT DOCUMENTS

| | | | | | |
|---|---|---|---|---|---|
| 183,555 | A | * | 10/1876 | Frazer | 222/142.9 |
| 1,531,245 | A | | 3/1925 | Ozanne | |
| 1,762,782 | A | | 6/1930 | Jepsen | |
| 2,804,767 | A | | 9/1957 | Schoen | 72/138 |
| 3,011,499 | A | * | 12/1961 | Tajan | 401/139 |
| 3,732,591 | A | * | 5/1973 | Gach | 15/245 |
| 5,605,259 | A | * | 2/1997 | Clawson et al. | 222/402.23 |
| 5,638,990 | A | * | 6/1997 | Kastberg | 222/106 |
| 5,661,211 | A | | 8/1997 | Todd | |
| 5,749,498 | A | * | 5/1998 | Lavoie et al. | 222/192 |
| 5,839,622 | A | * | 11/1998 | Bicknell et al. | 222/390 |

* cited by examiner

*Primary Examiner*—Joseph A. Kaufman
(74) *Attorney, Agent, or Firm*—Neil H. Hughes; Marcelo K. Sarkis; Kitt Sinden

(57) ABSTRACT

A portable device for dispensing drywall patching compound (mud) onto drywall is disclosed. The dispenser has a device on one end used for metering the drywall compound in a controlled manner and has affixed to at least one side an abrasive surface, preferably sand paper that can be used to smooth out the drywall compound when dry. As a preferred embodiment, the cap of the container contains a spatula or other device that can be used to shape the compound as it is being applied.

6 Claims, 4 Drawing Sheets

DRYWALL COMPOUND DISPENSING DEVICE

FIELD OF THE INVENTION

This invention relates to a drywall patching compound dispensing device, for use in effecting repair such as a crack or hole in drywall.

BACKGROUND OF THE INVENTION

Typically when conducting a drywall repair, it is necessary for a work person to use multiple tools. The patching compound normally is available premixed in a tub or container or must be mixed separately with water in another container and subsequently applied with a separate putty knife. Once the compound is dry, a separate sanding block is used to smooth out the surface being repaired prior to priming and painting.

Different types of applicators for dispensing materials relating to the filling of cracks or holes or the like, have been suggested in the prior art. Examples of such are found in U.S. Pat. No. 1,531,245 (Ozanne), in U.S. Pat. No. 1,762,782 (Jepsen), in U.S. Pat. No. 2,804,767 (Schoen), and in U.S. Pat. No. 5,661,211 (Todd).

The '245 Patent discloses a dispensing nipple secured to a tube. Squeezing the tube causes material to flow out of the nipple. Different configurations of nipples are illustrated.

The '782 Patent discloses a cement or adhesive compound formed into a cylindrical body and placed in a relatively thin and soft metal casing which is spirally corrugated. A cap of relatively stiff material is placed over the casing. The casing and material is easily cut for use, and the cap may then be screwed onto the casing and material from where the cut was made. The encased material, with the cap, is shipped in cardboard tubes.

The '767 Patent discloses a gun type of trowel secured to the end of a caulking gun. Different configurations of the trowel are disclosed. Actuating the caulking gun causes the caulking compound to flow out of the trowels in the desired configuration.

The '211 Patent discloses a dispenser with an asymmetrical configuration that contains a movable piston therein. This piston moves by means of rotation of a threaded rod.

It is therefore an object of the invention to provide a dispenser for storing and applying and smoothing drywall packing compound.

Further and other objects of this invention will become apparent to a man skilled in the art when considering the following summary of the invention and the more detailed description of the preferred embodiments described herein.

SUMMARY OF THE INVENTION

Accordingly to a primary aspect of the invention there is provided a device for dispensing dry wall patching compound on to drywall to effect a repair thereof, said device comprising a container for containing said compound and having two ends, and two sides, a mouth disposed at the first end, and an indexing device, for selectively advancing the dry wall patching compound disposed at the other end, said indexing device for moving the compound toward the mouth to apply the compound to drywall and having disposed proximate at least one side thereof an abrasive surface for sanding the area being repaired.

Preferably the abrasive surface further comprises a patch of said paper affixed to the side of said device.

Preferably a cap is provided to close the mouth of said device. Preferably said cap includes a spatula like tool for smoothing said patching compound.

The patching compound may be any known drywall patching compound.

The present invention describes a portable all-in-one dispensing device that can be used to effect a drywall repair. The device comprises a container used to hold the patching compound with two ends and two sides. One end has an opening including a mouth and the other end has an indexing device used for moving the compound toward the mouth to apply the compound to the drywall. A cap is provided to close the open end of the container and at least one of the sides of the container has affixed to it an abrasive surface.

The cross sectional shape of the dispenser can be of any suitable shape such as oval, square or rectangular and can be symmetrical or asymmetrical in geometry.

The indexing device may comprise a movable piston with or without a rotatable threaded rod that can be used to selectively move the drywall compound toward the mouth. All equivalent indexing devices are implied as useable including those which may be advanced by pressure, rotation, lever action, or the like.

The abrasive surface is preferably sand paper with a grit that is compatible with the surface being repaired but can be any abrasive surface known in the art such as a stiff wire brush.

DESCRIPTION OF THE PREFERRED EMBODIMENT

Figure 1:
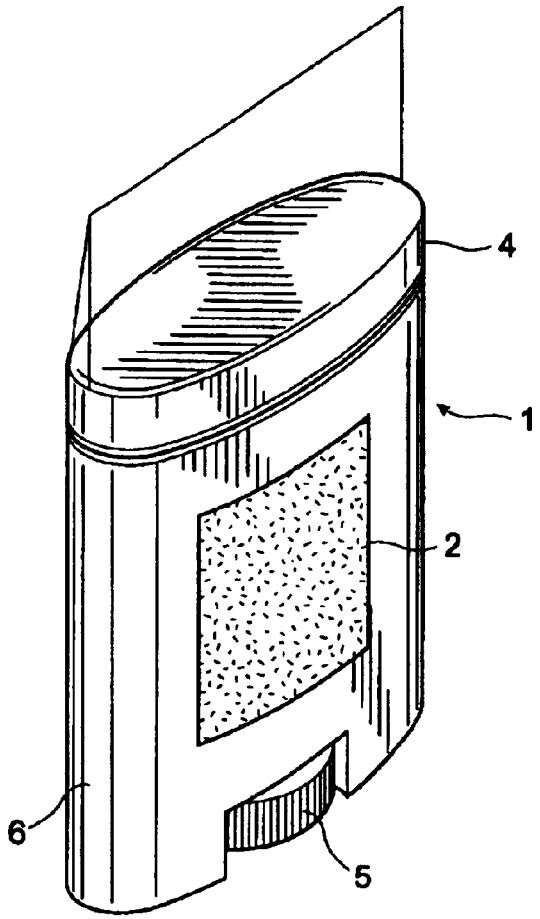
FIG. 1 is a perspective view of the dispensing device illustrated in a preferred embodiment of the invention.
Figure 2:
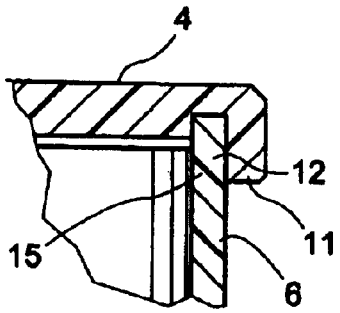
FIG. 2 is a close-up fragmentary side view of the cover portion 4 shown in FIG. 1.
Figure 3:
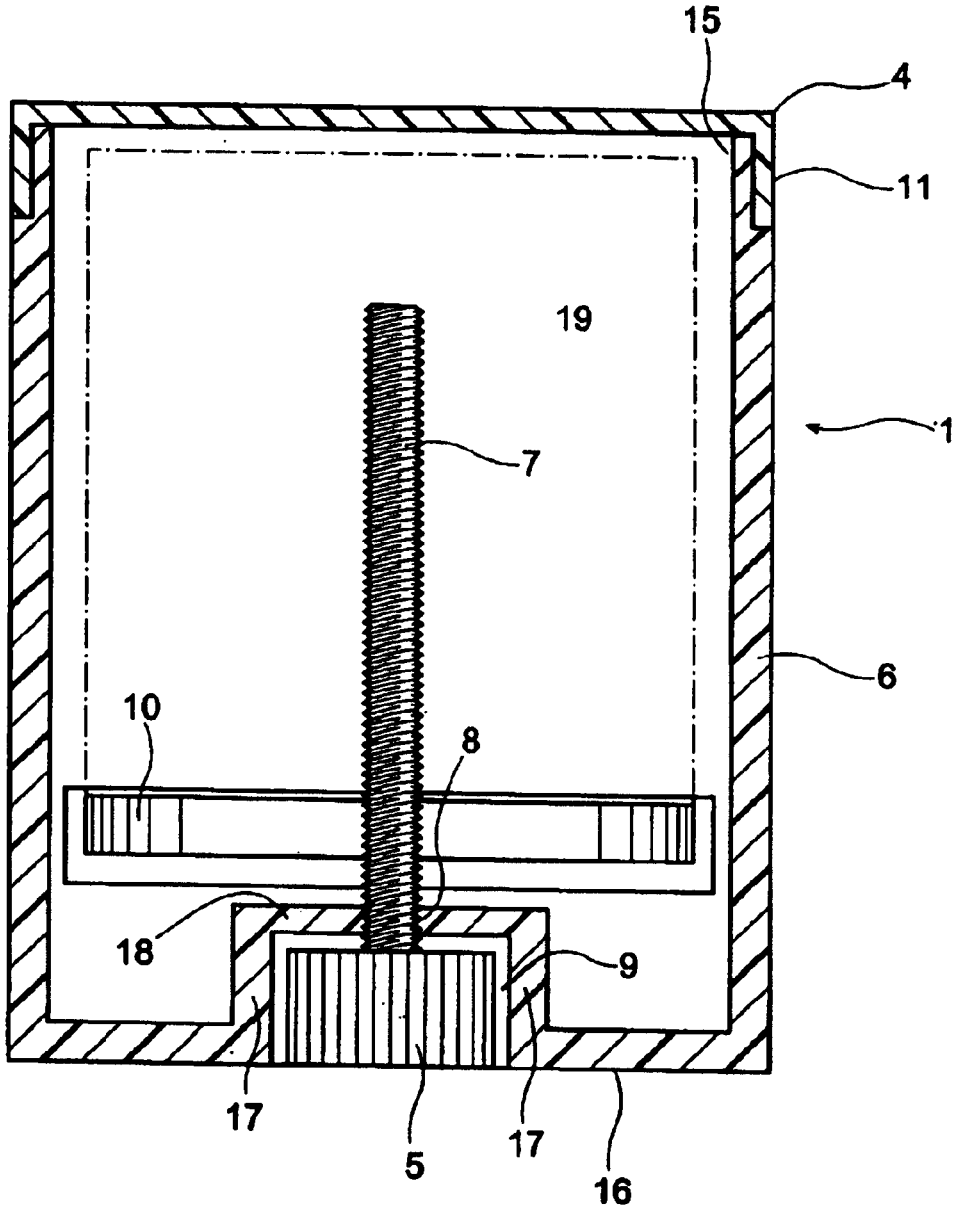
FIG. 3 is a cross sectional side view of the preferred embodiment of FIG. 1 illustrating the piston mechanism for dispensing the compound.
Figure 4:
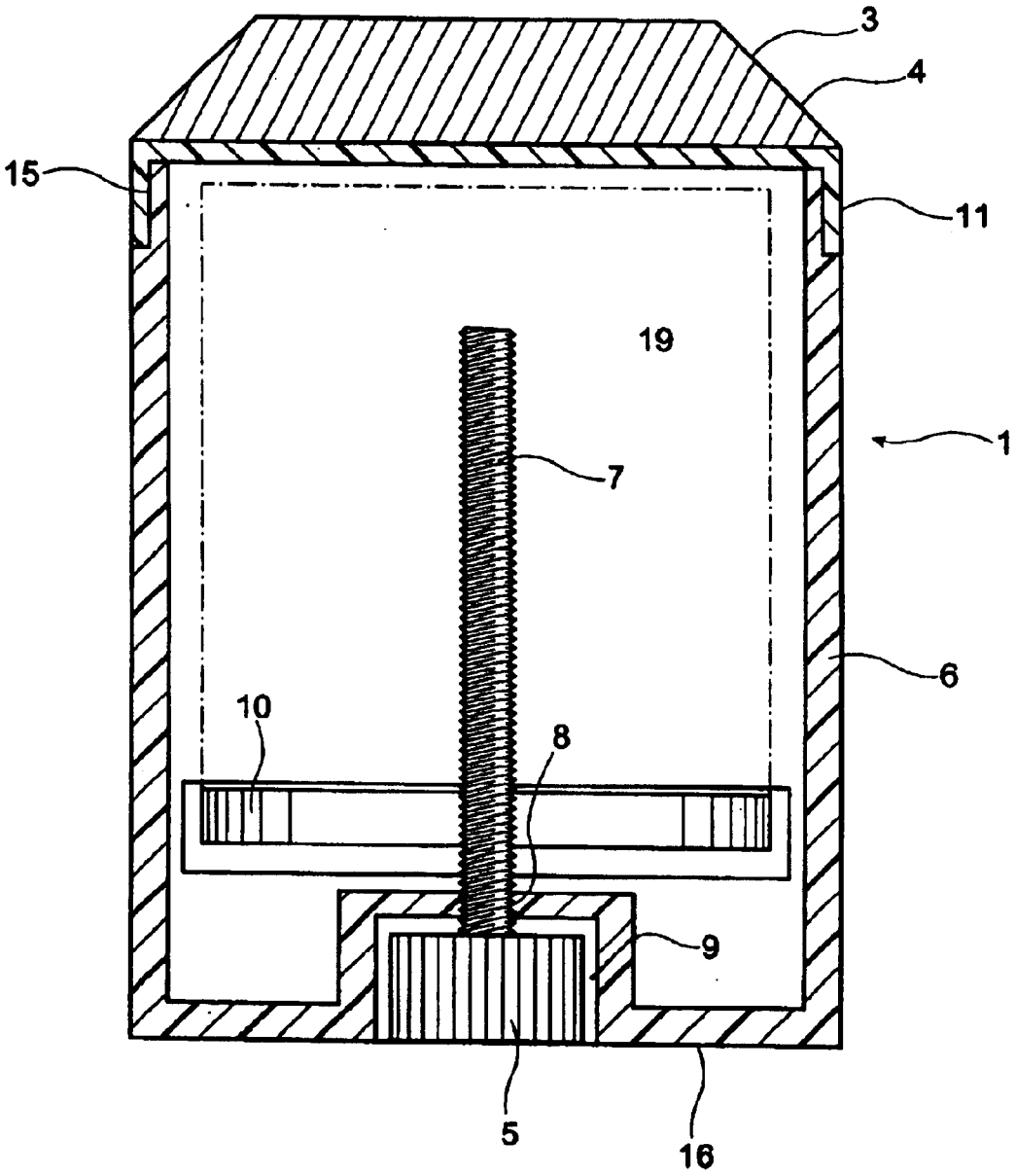
FIG. 4 is a cross-sectional view of the preferred embodiment of the invention similar to FIG. 3 containing having an integral spatula provided with the cap.
Figure 5:
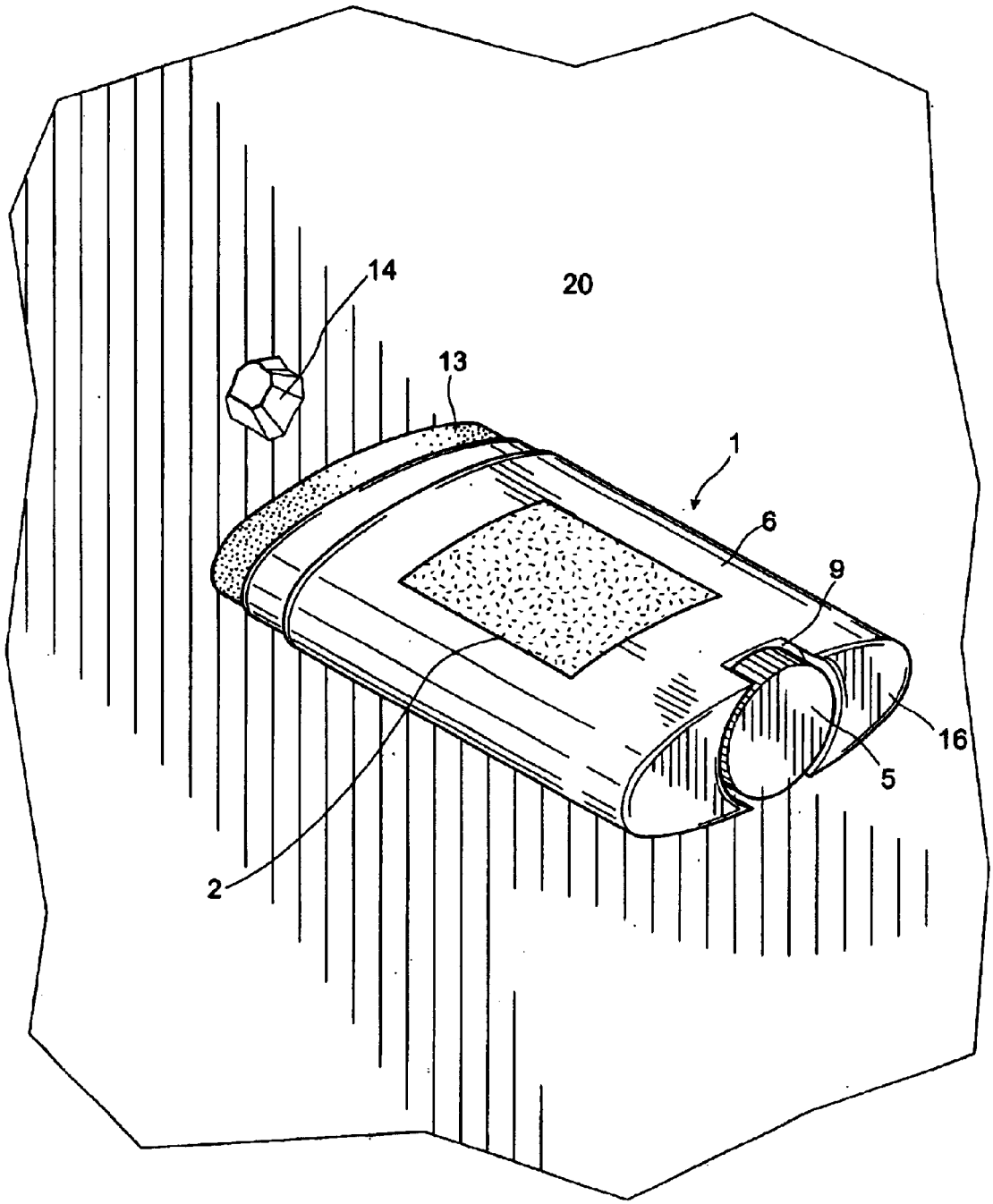
FIG. 5 is a perspective view showing the use of the device adjacent to a surface that is to be repaired, with the cap removed.

The drywall compound (13) of the present invention is disposed within a container (1), which has a generally oval configuration container, as best shown from FIGS. 1 and 5. The container or dispenser (1) comprises an oval shaped cylinder having a top shoulder (15) on which is disposed a cap (4) that preferably has as a part of it a spatula like tool (3). The cylinder (6) has affixed to it an abrasive surface (2) such as sand paper of a predetermined grit. The cylinder (6) also includes a bottom (16), with a recess (9) extending upwardly from the bottom (16). The recess (9) is generally cylindrical or circular in configuration, and includes a side recess wall (17) and a top recess wall (18). An aperture (8) extends through the top recess wall (18). The aperture (8) is centrally located with respect to the side recess wall (17).

Disposed within the recess (9) is a rotating disk (5) which is secured to a threaded rod (7). The threaded rod (7) extends through the aperture (8).

A piston (10) is disposed within the oval shaped cylinder housing (6). The configuration of the cylinder (6), which is noncircular, prevents the piston (10) from rotating as the threaded rod (7) rotates. The threaded rod (7) extends through a mating threaded aperture (8). Accordingly, rotation of the disk (5), and the threaded rod (7), causes the piston (10) to move upwardly and downwardly. A chamber (19) is defined within the housing (6) and above the piston (10). When the drywall compound (13) of the present invention is inserted within the chamber (19), the compound (13) may be dispensed in response to rotation of the disk (5) and its threaded rod (7).

A cap (4) is provided as shown in FIGS. 1, 2, 3 and 5, disposed on the top shoulder (15) of the cylinder housing (6). The cap (4) includes a downwardly extending wall or flange (11) which is disposed on the shoulder (15). The cap (4) may also have a spatula like tool (3), used to smooth out dispensed compound similar to a putty knife.

FIG. 5 comprises a perspective view of a portion of drywall (20) which includes a hole (14). The repair may be effected on a ceiling, a floor, or virtually any other surface in need of patching. The dispenser (1) of the present invention is shown adjacent to the hole (14), with compound (13) extending outwardly from the top or upper portion of the cylinder (6). The compound (13) is moved slightly out of the cylinder (6) by rotation of the disk (5), as described above.

The dispenser (1) is simply held adjacent to the hole (14), with the compound (13) pressed into the hole (14) followed by a transverse motion of the dispenser. The compound may then be smoothed with the spatula like tool (3) with the excess compound (13) outside of the hole (14) being wiped away. The compound (13) is a relatively quick drying compound and can be any known drywall compound formulation. Once dry, the compound may be appropriately sanded with the abrasive surface (2), provided with the dispenser, which is preferably sand paper or the like. The device therefore also provides a "sanding block". This feature is very convenient and provides this function without the need of a separate block.

It will be appreciated that one embodiment of the invention has been described and that modifications may be made therein by one skilled in the art without departing from the scope of the invention or unnecessarily limiting the scope of the appended claims. As many changes can be made to the preferred embodiments of the invention without departing from the scope thereof. It is intended that all matter contained herein be considered illustrative of the invention and not it a limiting sense.

The embodiments of the invention in which an exclusive property or privilege is claimed are as follows:

1. A device for dispensing dry wall patching compound on to drywall to effect a repair thereof, said device comprising a container for containing said compound and having two ends, and two sides, a mouth disposed at the first end, and an indexing device, for selectively advancing dry wall patching compound disposed at the other, said indexing device for moving the compound toward the mouth to apply to drywall and having disposed proximate at least one side of the device an integral abrasive surface for sanding the area being repaired once the patching compound dries utilizing the device only and without the need for supplementary devices.

2. The device of claim 1 wherein the abrasive surface further comprises a patch of sand paper affixed to the side of said device.

3. The device of claim 1 or 2 wherein a cap is provided to close the mouth of said device.

4. The device of claim 1 or 2 wherein said patching compound is any known drywall patching compound.

5. The device of claim 3 wherein said patching compound is any known drywall patching compound.

6. The device of claim 3 wherein said cap includes a spatula like tool for smoothing and shaping said patching compound.

* * * * *